US007340805B2

(12) United States Patent
Lin

(10) Patent No.: US 7,340,805 B2
(45) Date of Patent: Mar. 11, 2008

(54) COMBINATION STRUCTURE OF A ZIPPER HEAD

(75) Inventor: Yu-Pau Lin, Tao Yuan Hsien (TW)

(73) Assignee: Chung Chwan Enterprise Co., Ltd., Tao Yuan Hsien (TW)

( * ) Notice: Subject to any disclaimer, the term of this patent is extended or adjusted under 35 U.S.C. 154(b) by 92 days.

(21) Appl. No.: 11/335,653

(22) Filed: Jan. 20, 2006

(65) Prior Publication Data

US 2007/0169321 A1 Jul. 26, 2007

(51) Int. Cl.
*A44B 19/30* (2006.01)
*A44B 19/24* (2006.01)

(52) U.S. Cl. ..... 24/421; 24/424

(58) Field of Classification Search ..... 24/415, 24/418, 421, 424, 429
See application file for complete search history.

(56) References Cited

U.S. PATENT DOCUMENTS 2,222,529 A * 11/1940 Dahlin ..... 24/424
4,287,646 A * 9/1981 Kanzaka ..... 24/424
5,664,300 A * 9/1997 Mizuno ..... 24/424
6,647,599 B2 * 11/2003 Lin ..... 24/421

* cited by examiner

*Primary Examiner*—Robert J. Sandy
(74) *Attorney, Agent, or Firm*—Rosenberg, Klein & Lee

(57) ABSTRACT

A combination structure of a zipper head of the present invention comprises a zipper head, a pull tag, a pin lock, a spring piece, and a cover plate, wherein three components, the pin lock, the spring piece, and the cover plate, are composed of different materials and are mutually independent. Such a structure is different from the integrated structure of combining the above three components of the conventional invention. Hence the combination structure of the zipper head of the present invention provides sufficient stopping force via the stopping portion whilst being cheaper to produce, and easily manufactured and fabricated.

7 Claims, 5 Drawing Sheets

COMBINATION STRUCTURE OF A ZIPPER HEAD

BACKGROUND OF THE INVENTION

1. Field of the invention

The present invention relates to a combination structure of a zipper head, and more particularly to the combination structure of a zipper head that has a pin lock, a spring piece, and a cover plate.

2. Description of the Prior Art

Reference is made to FIG. 1 and FIG. 2. The combination structure of a zipper head of the prior art comprises a zipper 1, a pull tag 2, and a spring piece 3. The sequence of the fabrication of the conventional combination structure of a zipper head involves the end portion 22 of the pull tag 2 being installed in the sunken space 13 of the zipper head 1, and then the pull tag 2 is pushed to one end of the zipper head 1 so that the first fixing base 11 or the second fixing base 12 of the zipper head 1 is sheathed by means of the receiving hole 21 of the pull tag 2. Next, two ends of the spring piece 3 are separately and firmly mounted on the first fixing base 11 and the second fixing base 12 of the zipper head 1. The stopping portion 33 of the spring piece 3 then passes through the through hole 113 of groove 111 of the first fixing base 11 and inserts into the inside of the sliding groove 14 of the zipper head 1.

Furthermore, one end of the pull tag touching portion 32 of the spring piece 3 adjacent to the cover plate 31 is located in the bottom of the groove 121 of the second fixing base 12. Two ends of the cover plate 31 of the spring piece 3 are separately and firmly mounted on the first fixing base 11 and the second fixing base 12. The first fixing base 11 and the second fixing base 12 each have a cover plate fixing portion 112 and a cover plate fixing portion 122 thereon for fixing the cover plate 31 by means of the pushing force resulting from the curved shape of the cover plate fixing portion 112 and the cover plate fixing portion 122.

Reference is made to FIG. 2 showing the stopping portion 33 that has a stopping function due to the pushing force resulting from the stopping portion 33 that is driven by the pull tag touching portion 32 that presses against the zipper chain 4. However, the pushing force is released from the stopping portion 33 by pulling up the pull tag 2.

Because the cover plate 31, the pull tag touching portion 32, and the stopping portion 33 of the spring piece 3 are integrally formed, and the three components are made of the same material, the pull tag touching portion 32 needs to have an elastic nature and to be manufactured using costly materials. As such, the cover plate 31 and the stopping portion 33 are also manufactured using the same materials which contributes to even higher costs. In order to reduce costs, the cover plate 31 and the pull tag touching portion 32 are usually manufactured as small and as thin as possible. This often provides insufficient stopping force. Furthermore, because the cover plate 31, the pull tag touching portion 32, and the stopping portion 33 of the spring piece 3 are integrally formed, they must be accurately positioned in the manufacturing and fabricating process.

The inventor of the present invention recognizes the above shortage should be corrected and special effort has been paid to research this field. The present invention is presented with reasonable design and good effect to resolve the above problems.

SUMMARY OF THE INVENTION

It is a primary object of the present invention to provide a combination structure of a zipper head that provides a reasonable stopping force via the stopping portion while keeping manufacturing costs low as possible, and allows the zipper head to be easily manufactured and fabricated.

For achieving the object stated above, the combination structure of a zipper head of the present invention comprises a zipper head, a pull tag, a spring piece, and a cover plate. The zipper head has a first fixing base and a second fixing base mounted thereon, a sunken space is formed between the first fixing base and the second fixing base, each groove is separately disposed on an opposite side of the first fixing base and the second fixing base, and a pin locking hole is installed in the groove of the first fixing base. The pull tag has a receiving hole in one end thereof, and an end portion, coupled with the rear edge of the receiving hole, is installed in the sunken space of the zipper head. The pin lock has a head portion at one end thereof firmly installed in the groove of the second fixing base, a stopping portion, coupled with the other end of the pin lock, is passed through the pin locking hole and inserted into the inside of the zipper head, and a abdomen portion, which is between the head portion and the stopping portion of the pin lock, abuts the end portion of the pull tag. The zipper head further includes a spring piece, one end of which is firmly mounted on the second fixing base of the zipper head while the other end is disposed on the top of the pin lock, and a cover plate, of which two ends thereof are separately and firmly mounted on the first fixing base and the second fixing base.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following detailed description of the present invention.

DETAILED DESCRIPTION OF THE PREFERRED EMBODIMENTS

Figure 1:
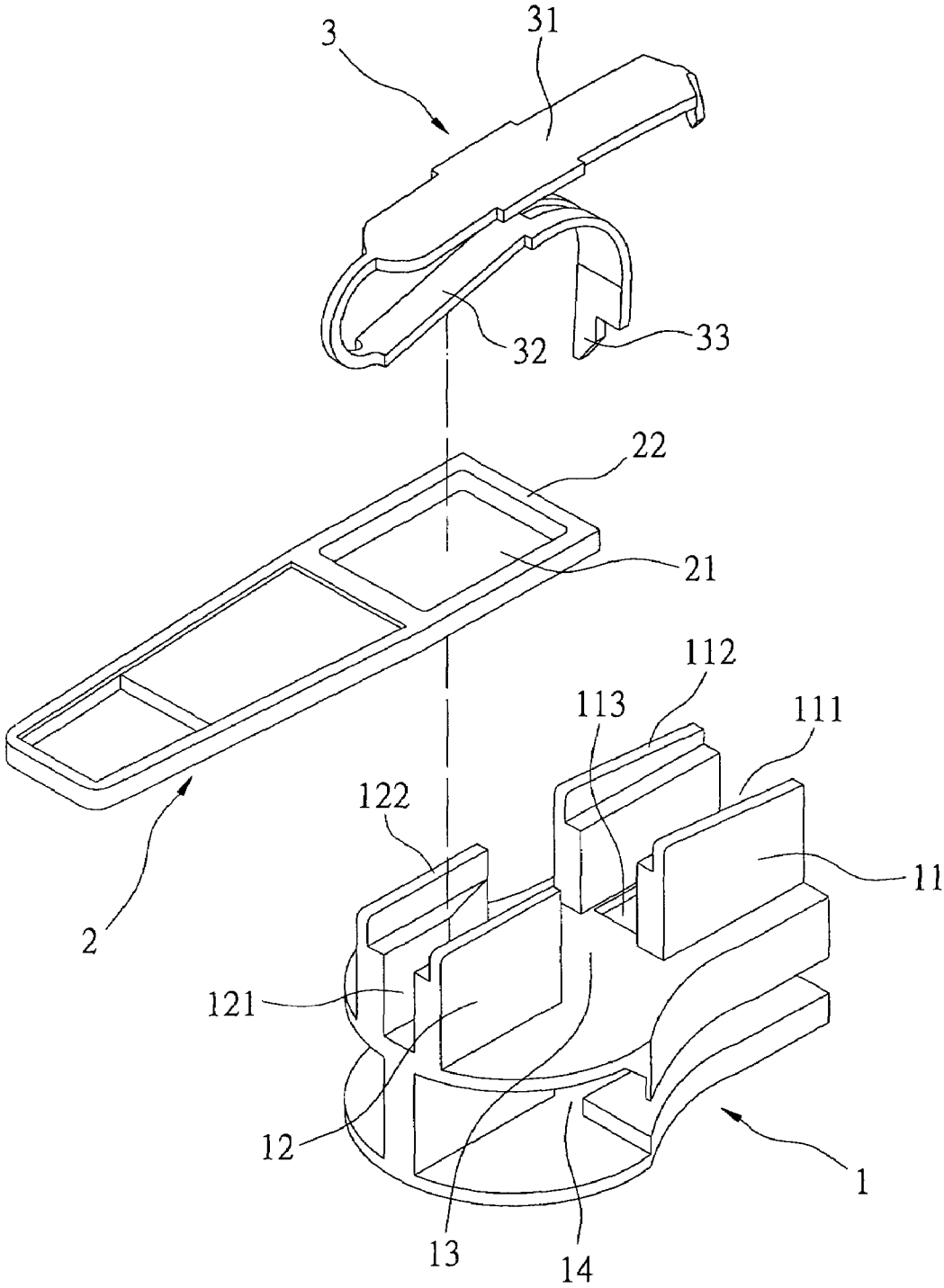
FIG. 1 PRIOR ART
FIG. 1 is an exploded perspective view of a zipper head of the prior art.
Figure 2:
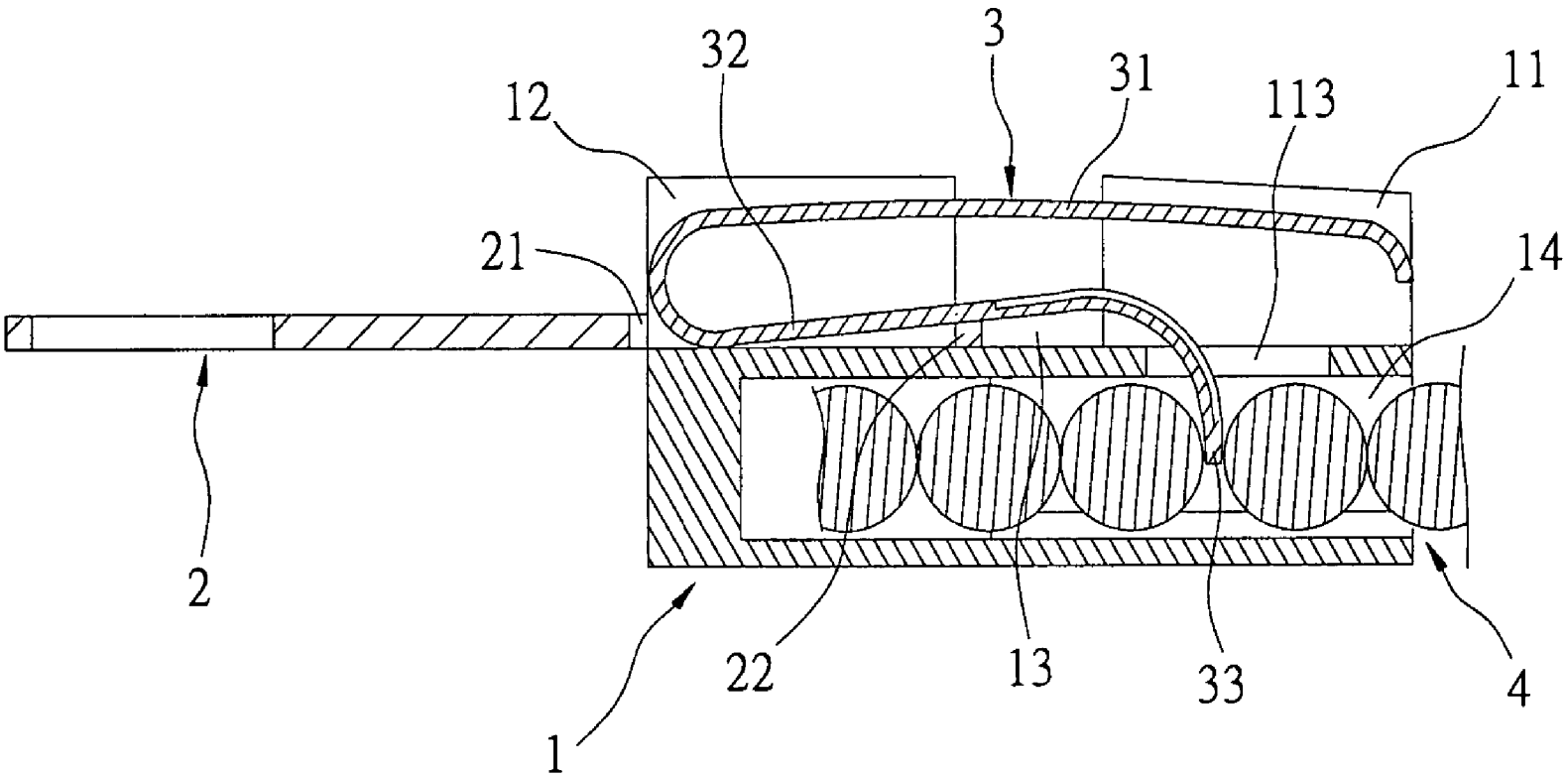
FIG 2 PRIOR ART
FIG. 2 is a cross-sectional view of a zipper head of the prior art.
Figure 3:
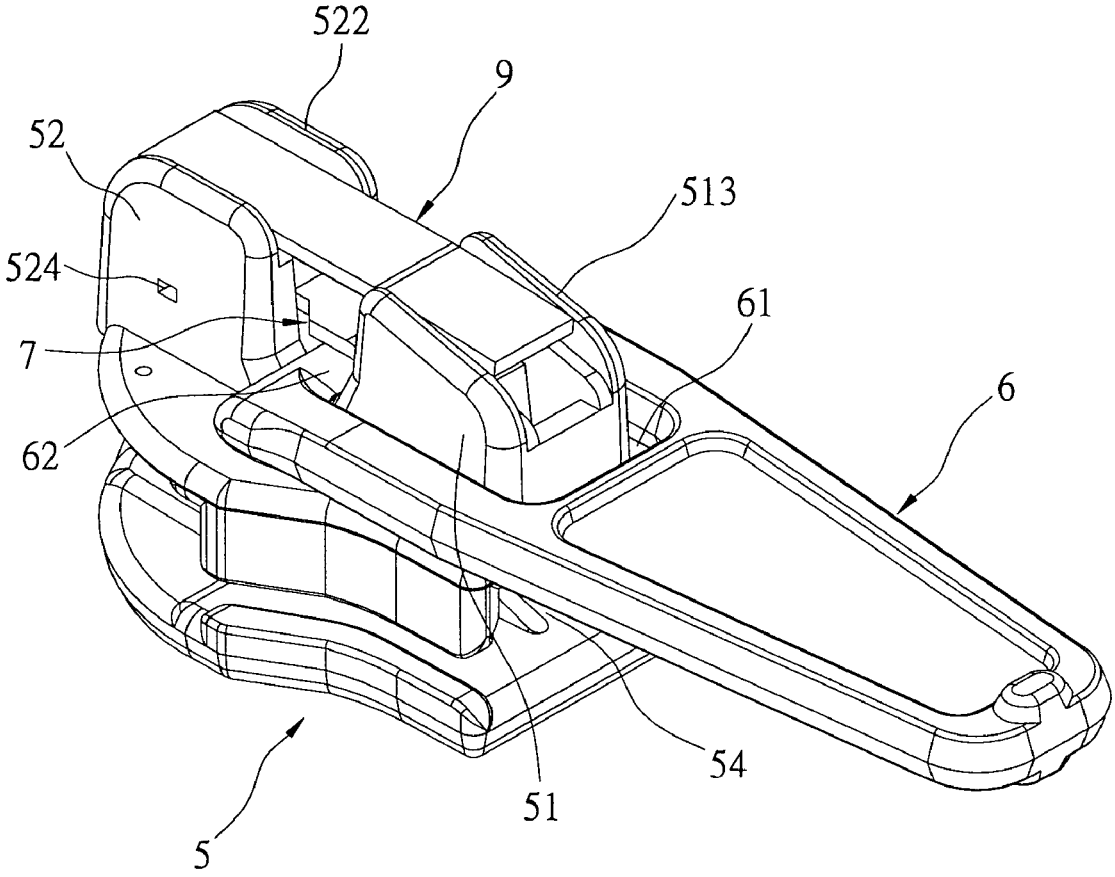
FIG. 3 is a perspective view of a zipper head of the present invention.
Figure 4:
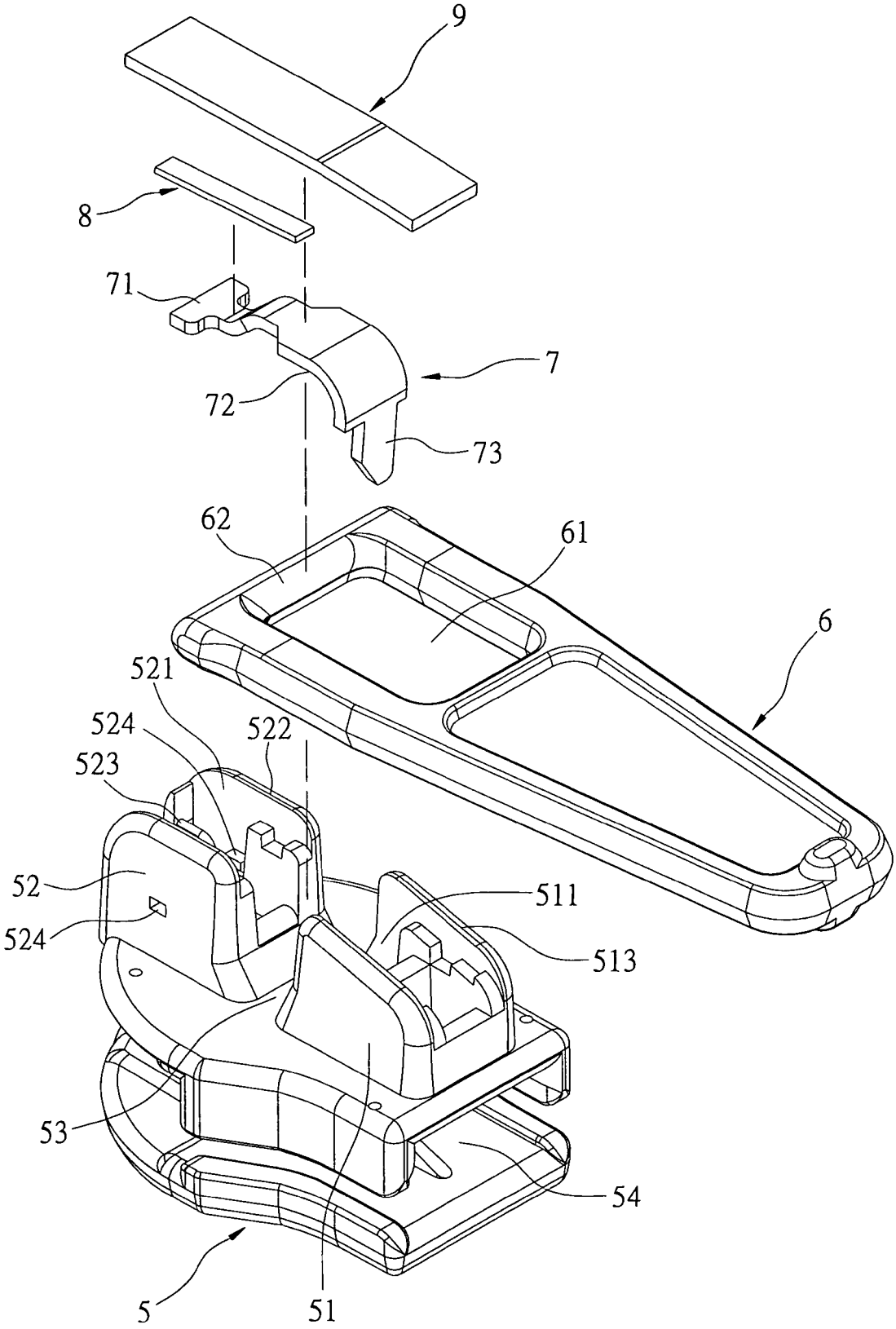
FIG. 4 is an exploded perspective view of a zipper head of the present invention.
Figure 5:
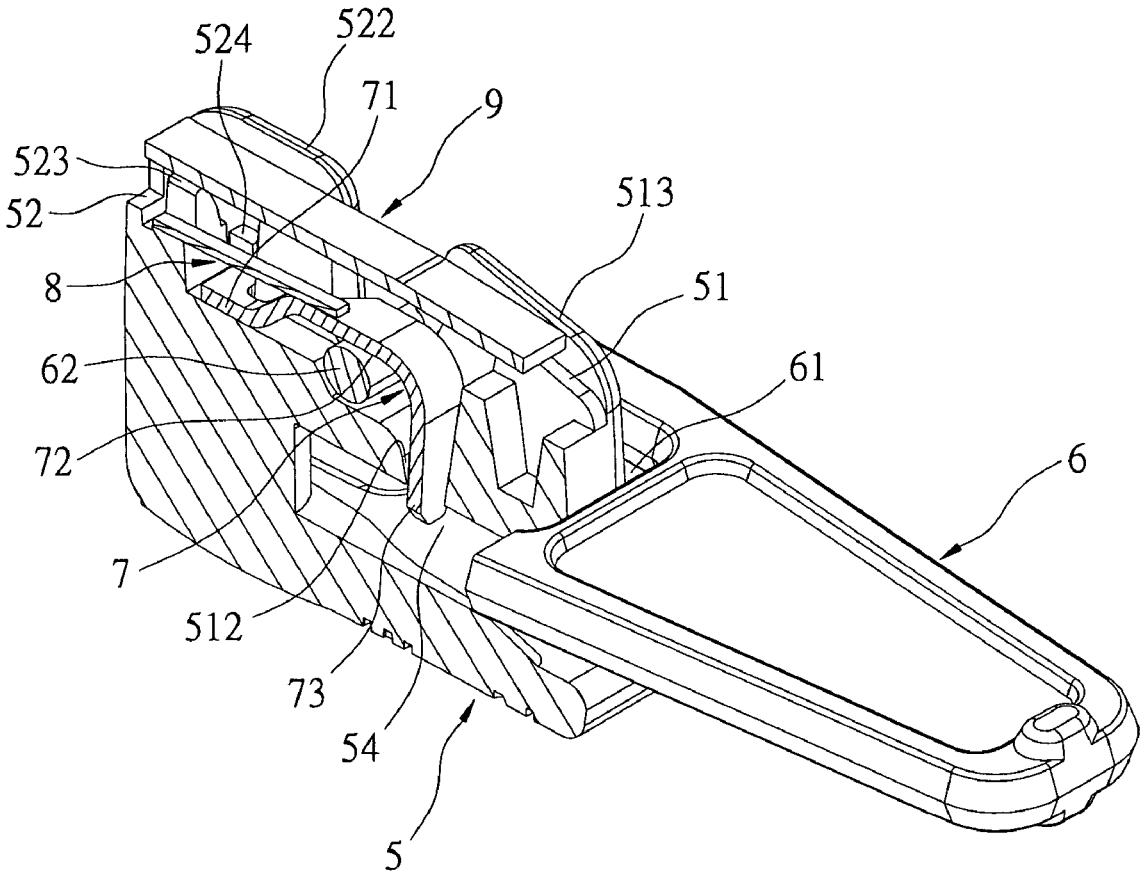
FIG. 5 is a perspective cross-sectional view of a zipper head of the present invention.

Reference is made to FIGS. 3 to 5. The combination structure of a zipper head of the present invention comprises a zipper head 5, a pull tag 6, a pin lock 7, a spring piece 8, and a cover plate 9. The zipper head 5 has a first fixing base 51 and a second fixing base 52 mounted thereon. A sunken space 53 is formed between the first fixing base 51 and the second fixing base 52, a groove 511 and a groove 521 are separately disposed on an opposite side of the first fixing base 51 and the second fixing base 52, and a pin locking hole 512 is installed in the groove 511 of the first fixing base 51. A pull tag 6 has a receiving hole 61 in one end thereof, and an end portion 62, coupled with the rear edge of the receiving hole 61, is installed in the sunken space 53 of the zipper head 5.

A pin lock 7 has a head portion 71 at one end thereof firmly installed in the groove 521 of the second fixing base 52. The groove 521 of the second fixing base 52 has two walls that are separately and outwardly disposed with a pin lock-fixing portion 524 for fixing the head portion 71 of the pin lock 7. The pin lock 7 is pivoted on the pin lock-fixing portion 524. The pin lock 7 has a stopping portion 73 at the other end thereof that passes through the pin locking hole 512 and inserts into the inside of the zipper head 5. The zipper head has a sliding groove 54 therein, the sliding groove 54 penetrates though two ends of the zipper head 5 and communicates with the pin locking hole 512, and the stopping portion 73 of the pin lock 7 passes through the pin locking hole 512 and inserts into the inside of the zipper head 5. A concave-shaped abdomen portion 72 is disposed between the head portion 71 and the stopping portion 73 of the pin lock 7, and abuts against the end portion 62 of the pull tag 6.

A spring piece 8, one end thereof is firmly mounted on the second fixing base 52 of the zipper head 5, and the second fixing base 52 has a spring piece fixing portion 523 for fixing one end of the spring piece 8 by means of the pushing force resulting from the curved shape of the spring piece fixing portion 523. The other end of the spring piece 8 is disposed on the top of the pin lock 7. A cover plate 9, two ends thereof are separately and firmly mounted on the first fixing base 51 and the second fixing base 52, and the first fixing base 51 and the second fixing base 52 each have a cover plate fixing portion 513 and a cover plate fixing portion 522 thereon for fixing the cover plate 9 by means of the pushing force resulting from the curved shape of the cover plate fixing portion 513 and the cover plate fixing portion 522.

Because three components, the pin lock 7, the spring piece 8, and the cover plate 9, are mutually independent they can be made of different materials. This allows the spring piece 8 to be manufactured using more expensive materials that have greater elasticity. Therefore, the pin lock 7 and the cover plate 9 can be manufactured using lower quality and cheaper materials. Thereby, the thickness of the stopping portion 73 of the pin lock 7 can be increased to improve the stopping force without raising costs too much. Furthermore, the combination structure of the zipper head is easily manufactured and fabricated because the pin lock 7, the spring piece 8, and the cover plate 9 are not integrally formed and the accurate positioning during the manufacturing and fabricating processes is less important.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A combination structure of a zipper head, comprising:

a zipper head having a first fixing base and a second fixing base mounted thereon, a sunken space is formed between the first fixing base and the second fixing base, a pair of grooves are separately disposed on an opposite side of the first fixing base and the second fixing base, a pin locking hole is installed in the groove of the first fixing base, and two protruding portions oppositely formed on inner walls of the groove of the second fixing base; a pull tag having a receiving hole in one end thereof, and an end portion, coupled with the rear edge of the receiving hole, installed in the sunken space of the zipper head;

a pin lock having a head portion at one end thereof firmly clipped between the two protruding portions and a bottom in the groove of the second fixing base, and a stopping portion, coupled with the other end of the pin lock, passes through the pin locking hole and inserts into the inside of the zipper head, and a abdomen portion, which is between the head portion and the stopping portion of the pin lock, abuts against the end portion of the pull tag;

a spring piece, one end thereof firmly mounted on the second fixing base of the zipper head and the other end which is disposed on the top of the pin lock; and a cover plate, two ends thereof separately and firmly mounted on the first fixing base and the second fixing base.

2. A combination structure of a zipper head as in claim 1, wherein the zipper head has a sliding groove therein, the sliding groove penetrates through two ends of the zipper head and communicates with the pin locking hole, and the stopping portion of the pin lock passes through the pin locking hole and inserts into the inside of the zipper head.

3. A combination structure of a zipper head as in claim 1, wherein the abdomen portion of the pin lock is concave-shaped.

4. A combination structure of a zipper head as in claim 1, wherein the second fixing base of the zipper head has two outer walls that are inwardly concaved to form the protruding portions in the groove.

5. A combination structure of a zipper head as in claim 1, wherein the second fixing base has a spring piece fixing portion thereon for fixing one end of the spring piece.

6. A combination structure of a zipper head as in claim 1, wherein the first fixing base and the second fixing base each have a cover plate fixing portion thereon for fixing the cover plate.

7. A combination structure of a zipper head as in claim 1, wherein the groove of the second fixing base has two walls that are separately and outwardly disposed upon a pin lock-fixing portion for fixing the head portion of the pin lock.

* * * * *